United States Patent [19]

Clingen

[11] Patent Number: 4,867,185

[45] Date of Patent: Sep. 19, 1989

[54] HAIR WAVING DEVICE

[76] Inventor: Ryal Clingen, 25232 Perch Dr., Dana Point, Calif. 92629

[21] Appl. No.: 98,687

[22] Filed: Sep. 21, 1987

[51] Int. Cl.[4] ..... A45D 2/40

[52] U.S. Cl. ..... 132/225; 132/224; 132/249; 132/263

[58] Field of Search ..... 132/9, 33 R, 39, 32 R, 132/38 A, 32 A, 32 B, 40 (U.S. only), 223, 224, 226, 225, 245, 249, 254, 255, 256, 261, 263

[56] References Cited

U.S. PATENT DOCUMENTS

| | | | |
|---|---|---|---|
| 2,465,745 | 3/1949 | Orr et al. | 132/39 |
| 3,680,565 | 8/1972 | Giles et al. | 132/9 |
| 4,027,684 | 6/1977 | Mueller | 132/40 |
| 4,261,375 | 4/1981 | Anderson | 132/32 R |
| 4,327,754 | 5/1982 | Hildreth | 132/40 |
| 4,739,776 | 4/1988 | Prijic | 132/9 |

*Primary Examiner*—Gene Mancene
*Assistant Examiner*—Adriene J. Lepiane
*Attorney, Agent, or Firm*—James E. Brunton

[57] ABSTRACT

A hair waving device which can be quickly and easily interconnected with adjacent devices of identical construction so that the devices disposed proximate the outer extremities of the strand of hair to be waved, where the individual hairs are very fine, are held firmly in place by the devices clamped proximate the root portion of the strand where the individual hairs are of larger diameter.

3 Claims, 2 Drawing Sheets

HAIR WAVING DEVICE

BACKGROUND OF THE INVENTION

1. Field of the Invention

The present relates generally to hair waving devices. More particularly, the invention concerns a novel hair waving device which is particularly adapted for use with permanent waving solutions and which can quickly be interconnected with mating devices to enable efficient uniform waving of long strands of hair.

2. Discussion of the Prior Art

In the past, curling and crimping devices have been made in a variety of configurations and function to crimp the hair with various degrees of effectiveness. Most of these devices, however, do not fully expose the hair to a waving or washing solution and, therefore, do not perform in an optimum fashion for hair waving operations wherein waving solutions are used.

Another drawback of many prior art waving devices resides in the fact that, while the device may function to effectively grip or clamp the strand of hair near the roots, where the diameter of the individual hairs tends to be larger, they are not suitable for securely gripping the strand of hair n near the end where the hair is very fine. As a person's; hair grows in length, and particularly when a given strand of hair reaches a substantial length, the individual hairs become extremely fine and of a substantially decreased diameter from the diameter of the individual hairs located near the roots. For this reason most prior art crimping devices tend to slip off the strand of hair at the extremities of the strand, thereby failing to accomplish the desired uniform waving effect. Further, the inability of the prior art devices to remain in place along the length of the strand is most annoying and considerable time is lost in continually replacing the gripping devices.

One of the most successful prior art hair curling and crimping devices is that described in U.S. Pat. No. 4,261,375, which patent is owned by to the assignee of the present invention. The device of this patent functions extremely well, in most normal situations. Like the device of the present invention, this device is constructed from a generally rectangular structure having first and second halves joined by a center section molded from the single piece of relatively soft yieldable plastic. With this construction, the center section forms a living hinge integral with the two halves. The hair to be waved can be placed between the halves and the halves bent toward each other so that the hair is pressed therebetween exposing the strand of hair on both sides to the upstanding ridges and slots formed in each of the halves of the device. While the device of the '375 patent functions in a superior manner to accomplish a crimping or waving of the strand of hair in the area proximate the root portion of the strand, the device tends to slip off the strand of hair at locations proximate the outer end of the strand where the individual hairs have become extremely fine and, due to breakage, considerably thinner.

The device of the present invention overcomes the drawbacks of the prior art by providing a novel construction which enables a plurality of the individual hair waving devices to be quickly and easily interconnected so that the devices disposed proximate the outer tapered, or thinner, extremities of the strand of hair are held firmly in place by the devices clamped proximate the root portion of the strand. With this unique arrangement, a series of interconnected curling devices can be quickly constructed in a manner so that each device will remain securely in position along the entire length of the strand of hair. The devices will not slip off even the longest strand of hair and will function to uniformly wave the hair in a highly superior manner.

SUMMARY OF THE INVENTION

It is an object of the present invention to provide a hair waving device of a novel configuration which enables the device to be quickly and easily interconnected with an adjacent device of similar construction.

Another object of the invention is to provide a hair waving device of the aforementioned character which fully exposes the hair to a waving or washing solution and is highly effective for waving very long strands of hair. More particularly, it is an object of the invention to provide a device of the character described which is provided with mating end sections adapted to be readily interconnected with adjacent crimping devices of identical construction to provide a series of removably interconnected devices extending along the entire length of a very long strand of hair.

Still another object of the invention is to provide a hair waving device as described which is easy to use, highly durable and one which can be inexpensively manufactured.

DESCRIPTION OF THE INVENTION

Figure 1:
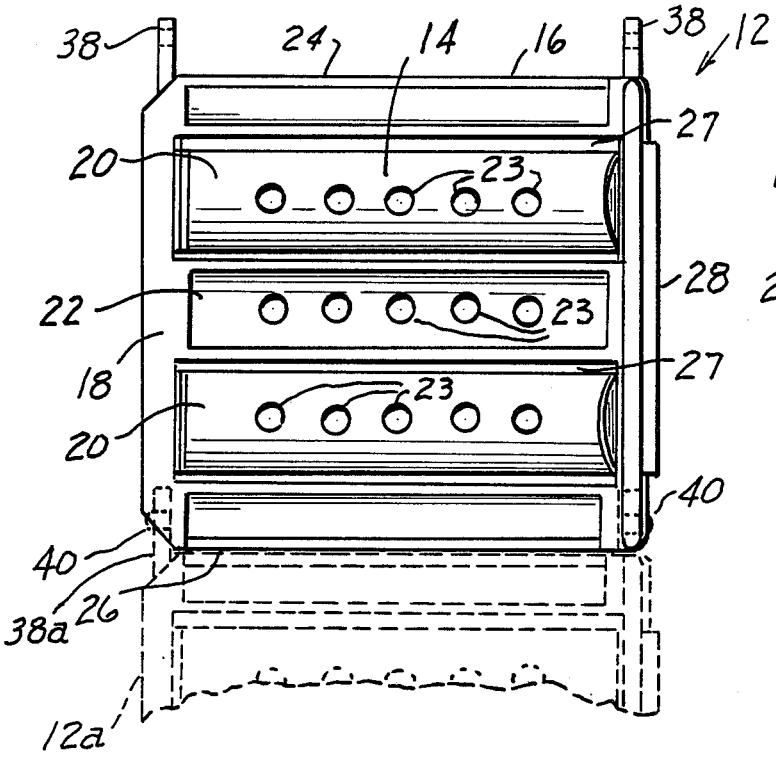
FIG. 1 is a plan view of one form of the hair waving device of the present invention.

Referring to the drawings, and particularly to FIGS. 1 through 5, one form of the hair waving device of the present invention is thereshown and generally designated by the numeral 12. The device comprises a structure having first and second halves 14 and 16 joined by a central section 18. In its preferred form, the device is molded of a single piece of relatively soft yieldable plastic so that the center section 18 forms a living hinge integral with the two halves 14 and 16.

Figure 2:
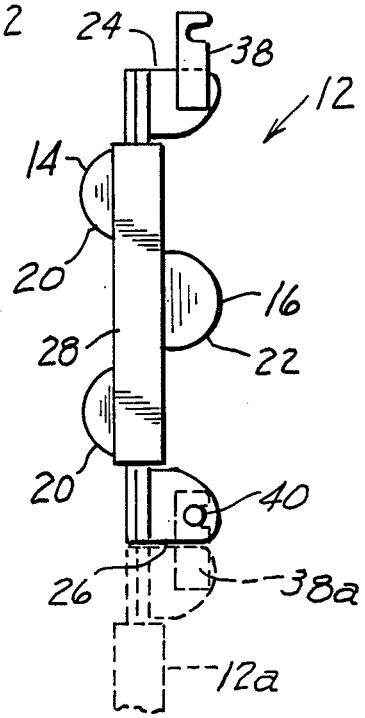
FIG. 2 is a side elevational view of the waving device.

First half 14 is provided with a pair of longitudinally spaced ridges 20 which are in the form of half cylinders. Second half 16 has a single ridge 22 which is also in the form of a half cylinder. Ridge 22 is closely receivable within half cylindrically shaped members 20 when the device is in a closed configuration as shown in FIG. 2 of the drawings. Ridges 20 and 22 have a plurality of transversely spaced openings 23 for facilitating application of waving solution. Second half 16 also includes first and second edge portions 24 and 26, respectively, which, together with ridge 22 form slots 27 adapted to closely receive ridges 20 when the device is in a closed position.

Figure 3:
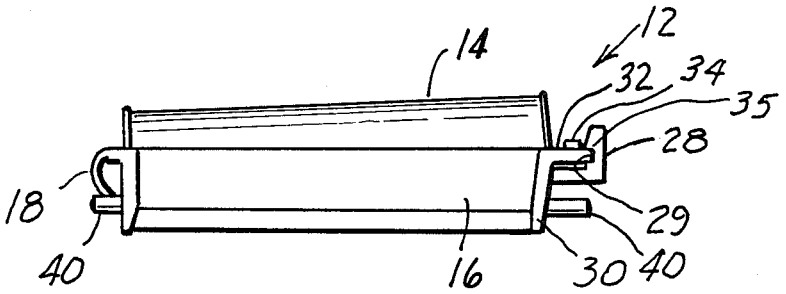
FIG. 3 is a view of one end of the device.
Figure 5:
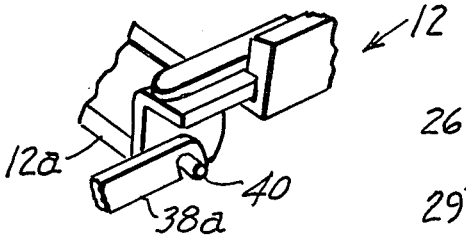
FIG. 5 is a fragmentary perspective view illustrating the construction of the interlocking mechanism of one form of the invention which enables one waving device to be quickly and easily removably interconnected with an adjacent device of identical construction.
Figure 4:
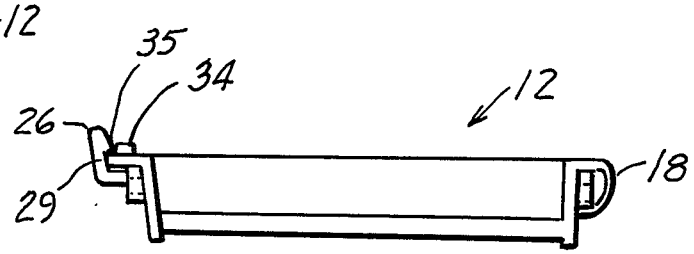
FIG. 4 is a view of the opposite end of the device from that shown in FIG. 3.

Referring particularly to FIG. 3, first half 14 is provided with a longitudinally extending side wall 28 having a longitudinally extending, generally channel shaped groove 29. Second half 16 is similarly provided with a longitudinally extending, inwardly disposed side wall 30 terminating at one edge in an outwardly extending, generally planar portion 32. Formed on the upper surface of portion 32 is a longitudinally extending rib-like member 34 which is spaced inwardly from the outer edge 35 of portion 32. As indicated in FIG. 3, these components comprise latching means for latching the first and second halves together. With the construction shown, when the first and second halves are moved into a mating relationship due to the flexing of center section 18, edge portion 35 will be closely received within channel 29 so that the two halves will be secured together in a mating relationship illustrated in FIG. 3. In this mating relationship, half cylinder shaped portions 22 extend intermediate the slots 27 (FIG. 1).

An important feature of the device of the present invention resides in the provision of interconnection means for removably interconnecting the device with an adjacent device of identical construction. The interconnection means enables a series of the devices to be removably interconnected in an elongated series for use in waving very long strands of hair. As previously discussed, since the hair is much finer at the outer end of the strand, unless the devices clamped about the hair proximate the outer end of the strand are somehow anchored, they will tend to slip off the strand thereby leaving the end of the strand unwaved.

With the novel construction of the device of the present invention, each of the devices can be anchored to its adjacent device. Accordingly, the devices disposed closer to the root portion of the strand, which more securely grip the strand of hair, functions as anchors for the devices disposed proximate the end of the strand. In the present embodiment of the invention, these interconnection means comprise a pair of first connector elements 38 carried by the first edge 24 of second half 16 and a pair of second connector elements 40 carried by second edge 26 of second half 16. As best seen by referring to FIG. 5, the second connector elements 40 of the device thereshown are adapted to be mateably interconnected with first connector elements, designated by the numeral **38*a***, provided on an adjacent device of identical construction.

In the embodiment of the invention shown in FIGS. 1 through 5, the first connector elements 38 are provided in the form of a pair of hook shaped members and the second connector elements comprise a pair of transversely extending post shaped members. In FIGS. 1 and 2, a second device **12*a* (illustrated in phantom) is shown mateably interconnected with an identical device 12. In this second device, the hook-like connectors are also designated by the numeral 38*a***.

Figure 6:
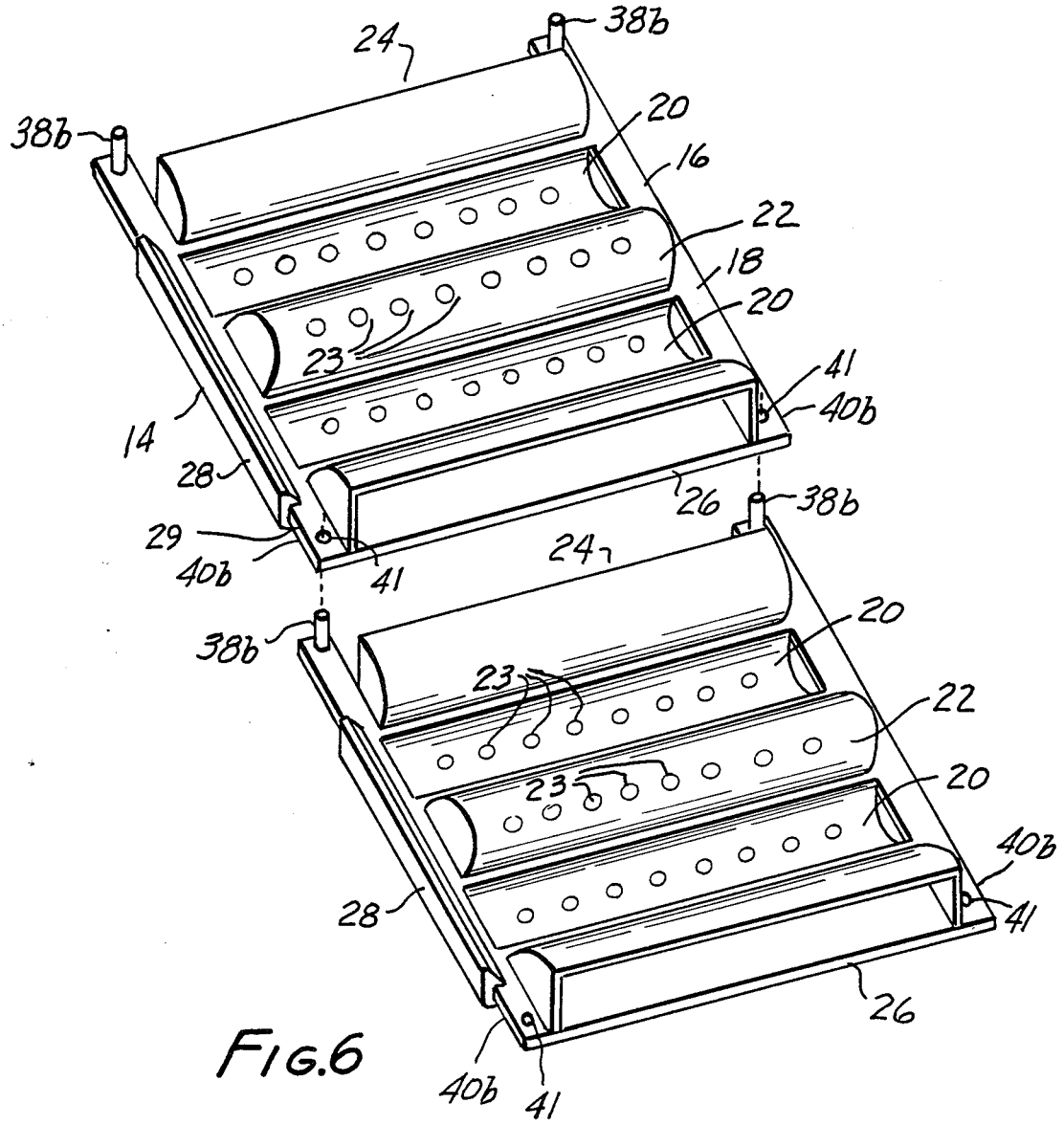
FIG. 6 is a generally perspective view of an alternate form of the waving device of the invention showing two devices in position for mateable interconnection.

In the embodiment of the invention shown in FIG. 6, the first connector elements, designated as **38*b*, comprise a pair of upstanding post shaped members. In this form of the invention, the second connector elements 40 comprise a pair of generally planar walls designated in FIG. 6 by the numeral 40*b* each having an aperture 41 extending therethrough and adapted to mateably receive upstanding post shaped members 38*b* provided on an adjacent hair waving device of identical construction. The form of the invention shown in FIG. 6** is identical to that previously described, save for the interconnection means and like numerals are used to identify like components.

In using the device of the invention, a starting device 12, in its open configuration, is clamped about a strand of hair proximate the root portion. The device is held in a clamping configuration by the latching means, that is by edge 35 of the second half 16 being received within groove or channel 29 of the first half 14. A second device is then clamped about the strand of hair at a location immediately adjacent the starting device. The interconnection means are then mated to hold the devices together. In the form of the invention shown in FIGS. 1 through 5, this is accomplished by placing the hook-like members **38*a* over post members 40. In the embodiment shown in FIG. 6, posts 38*b* are inserted into open hook 41**. Next, a third device is clamped about the strand of hair next to the second device and is interconnected thereto via the interconnection means. The process can be repeated to add as many devices as may be required to wave the entire strand of hair. As the end of the strand is reached, the devices will be securely held in position by the previously attached devices, which devices are securely clamped about the larger diameter hairs which make up the strand.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A hair waving device comprising:

(a) a structure having first and second halves joined by a center section molded from a single piece of a relatively soft, yieldable plastic whereby the center section forms a living hinge integral with the two halves, one of said halves including first and second edge portions;

(b) a series of alternating upstanding curved ridges and slots formed in each of said halves running at a right angle to said center section, said ridges and slots being complementary to one another whereby a ridge can fit into a mating slot and a strand of hair can be placed between the halves, the halves bent toward each other so that the hair is pressed through the slots by said ridges, exposing the hair on both sides of said halves;

(c) latching means for latching the two halves, said latching means comprising a longitudinally extending edge portion on one of said two halves and a longitudinally extending channel formed in the other of said two halves; and (d) interconnection means for removably interconnecting the device with an adjacent device of identical construction to form an elongated series of devices adapted to wave a long strand of hair along the entire length thereof, said interconnection means comprising a pair of transversely spaced first connector elements integrally formed with said first edge of said one of said halves and a pair of transversely spaced connector elements carried by said second edge of said one of said halves, said first connector elements of the device being mateably interconnectable with said second connector elements provided on an adjacent device of identical construction, said first connector elements comprising a pair of longitudinally extending hook-shaped members and in which said connector elements comprise a pair of transversely extending post-shaped members integrally formed with one of said halves and adapted to mutually engage said hook-shaped members provided on an adjacent hair waving device of identical construction.

2. A hair waving device as defined in claim 1 in which said first connector elements comprise a pair of upstanding post-shaped members integrally formed with one of said halves and in which said second connector elements comprise a pair of generally planar walls each having a circular shaped aperture therethrough adapted to mateably receive upstanding post-shaped members provided on an adjacent hair waving device of identical construction.

3. A hair waving device comprising:

(a) a structure having first and second halves joined by a center section molded from a single piece of a relatively soft, yieldable plastic whereby the center section forms a living hinge integral with the two halves, one of said halves including first and second edge portions;

(b) a series of alternating upstanding curved ridges and slots formed in each of said halves running at a right angle to said center section, said ridges and slots being complementary to one another whereby a ridge can fit into a mating slot and a strand of hair can be placed between the halves, the halves bent toward each other so that the hair is pressed through the slots by said ridges, exposing the hair on both sides of said halves;

(c) latching means for latching the two halves, said latching means comprising a longitudinally extending edge portion on one of said two halves and a longitudinally extending channel formed in the other of said two halves; and (d) interconnection means for removably interconnecting the device with an adjacent device of identical construction to form a longitudinally extending, elongated series of devices adapted to wave a long strand of hair along the entire length thereof, said interconnection means comprising a pair of first longitudinally extending hook-shaped connector elements integrally formed with said first edge of said one of said halves and a pair of second connector elements comprising transversely extending post-shaped members integrally formed with said second edge of said one of said halves, said first elements of the device being mateably interconnectable with said second connector elements provided on an adjacent device identical construction.

* * * * *